United States Patent [19]

Castonguay et al.

[11] Patent Number: 4,482,877

[45] Date of Patent: Nov. 13, 1984

[54] ELECTRIC CIRCUIT BREAKERS HAVING FAST SHORT CIRCUIT RESPONSE

[75] Inventors: Roger N. Castonguay, Terryville; Charles L. Jencks, Avon, both of Conn.

[73] Assignee: General Electric Company, New York, N.Y.

[21] Appl. No.: 479,617

[22] Filed: Mar. 28, 1983

[51] Int. Cl.[3] ..... H01H 3/00

[52] U.S. Cl. ..... 335/191; 335/192; 335/16; 200/244

[58] Field of Search ..... 335/15, 16, 185, 186, 335/187, 188, 189, 190, 191, 192, 193, 194, 195; 200/244, 245, 250

[56] References Cited

U.S. PATENT DOCUMENTS 3,492,609 1/1970 Murai et al. ..... 335/16

3,646,488 2/1972 Iida et al. ..... 335/195

4,144,513 3/1979 Shaffer et al. ..... 335/16

*Primary Examiner*—E. A. Goldberg

*Assistant Examiner*—George Andrews

*Attorney, Agent, or Firm*—R. A. Menelly; W. C. Bernkopf; Fred Jacob

[57] ABSTRACT

A thermal magnetic circuit interrupter with instantaneous short circuit current response utilizes a hook-shaped contact arm pivotally mounted on the operating mechanism at the end of the contact arm most distant from the contact. A saddle-type torsion spring proximate the pivot end of the contact arm provides adequate contact pressure while allowing the contact to immediately respond to magnetic forces generated under short circuit conditions. The immediate separation of the contacts reduces the current let-through the operating mechanisms while the tripping mechanism operates to trip the breaker.

10 Claims, 5 Drawing Figures

ELECTRIC CIRCUIT BREAKERS HAVING FAST SHORT CIRCUIT RESPONSE

BACKGROUND OF THE INVENTION

The invention relates to molded case circuit breakers of the type employing a movable and a fixed contact and an operating mechanism arranged to open and close the contacts under the influence of an operating handle and a trip mechanism. The trip mechanism and operating mechanism are similar to that described within U.S. Pat. No. 3,605,052 to Herbert M. Dimond et al. and to U.S. patent application Ser. No. 479,616 entitled "Electric Circuit Breakers Having Fast Short Circuit Response". Which patent and application are incorporated herein for purposes of reference and which contains a detailed desciption of the operation of both the trip and operating mechanisms.

The contact assembly within the Dimond et al. patent includes a contact spring for providing a high contact force between the contacts to ensure a minimum resistance to the transfer of electrical current therebetween. As described within the aforementioned patent, the contact arm is mechanically linked to a crossbar which in turn is tripped in a counterclockwise direction to separate the contacts. Under severe short circuit test conditions the contacts are held in a closed condition under the influence of the contact spring until the trip mechanism is able to rotate the crossbar and separate the contacts. Until the contacts become separated, the short circuit current let-through transfers through the various current carrying elements of the circuit breaker. The thermal and mechanical effects created by the high let through energy could conceivably cause damage to the elements if these energy values are excessive.

The purpose of the instant invention is to provide a contact arm assembly which rapidly separates the contacts upon short circuit current conditions to substantially decrease the thermal and mechanical stresses on the circuit breaker elements. This permits a higher safety margin for each circuit breaker element, and in some cases, some elements may be designed to be more cost effective and still maintain a high safety margin.

SUMMARY OF THE INVENTION

The invention comprises an electrical circuit breaker which includes a contact arm having a hook-shaped bend configuration and pivotally mounted at the end of the contact arm opposite from the contact. A multiple winding contact spring is arranged proximate the pivot to allow the contacts to be held with sufficient contact pressure during normal conditions and to rapidly blow open upon short circuit conditions.

DESCRIPTION OF THE PREFERRED EMBODIMENT

Figure 1:
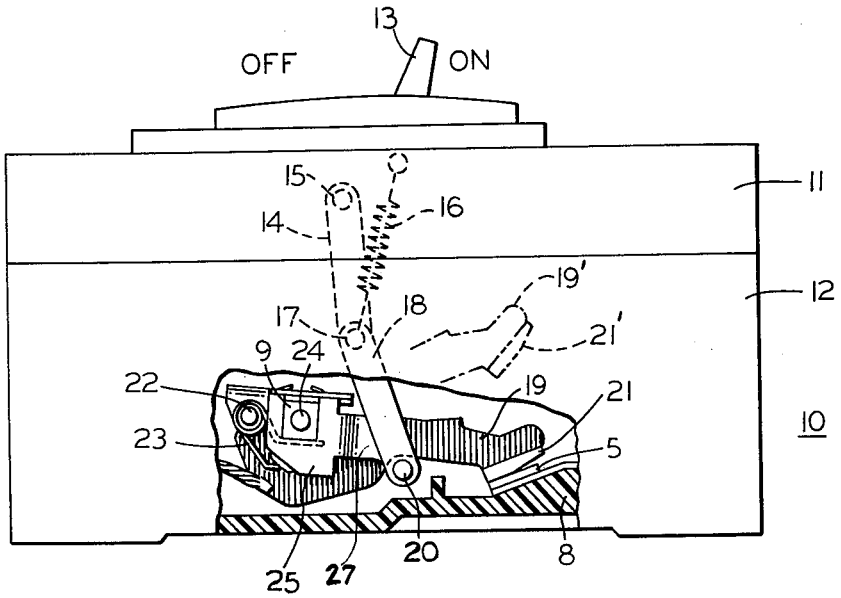
FIG. 1 is a side view in partial section of a circuit breaker employing the contact arm configuration according to the invention.

FIG. 1 contains a molded case circuit breaker 10 similar to that described within the aforementioned patent to Dimond et al. which includes a cover 11 attached to a base 12 and containing an operative on-off handle 13 arranged on the cover. The handle is mechanically connected to an operating mechanism similar to that described within the patent to Dimond et al. which contains an upper link 14 which pivots about pivot pin 15 and an over-center spring 16 which connects to a knee pin 17 which also serves to pivotally connect a lower link 18. A contact arm 19 is supported by means of a pin 20 against the bias of contact spring 23. A movable contact 21 is affixed at one end of the contact arm and is held against a fixed contact 5 by means of the contact pressure provided by contact spring 23. The contact arm is pivotally connected by means of pin 22 to a contact carrier 25 and extends between the contact carrier legs 27. The contact carrier is mechanically attached to the circuit breaker crossbar 9. The crossbar is arranged within the circuit breaker housing 8 by means of a pair of pivots 24, which extend from the end of the crossbar and which allows the crossbar to rotate into a counterclockwise position under the influence of the over-center spring when the breaker becomes tripped. The mechanical linkage between the crossbar 9, contact carrier 25 and contact arm 19 forces the contact arm to rotate along with the crossbar and thereby separates movable contact 21 away from fixed contact 5 to open the circuit through the breaker. The arrangement of contact arm 19 within the breaker can best be seen by referring now to FIG. 2. The contact carrier 25 is fixedly secured to the crossbar 9 by means of tabs 26 and the pin 20 which secures the contact arm between the contact carrier legs 27 is positioned between a pair of ribs 28 molded within the breaker housing. A unique saddle-type spring 23 is arranged around pin 22 with a number of body windings 38 on each side of the contact carrier 25.

Figure 3:
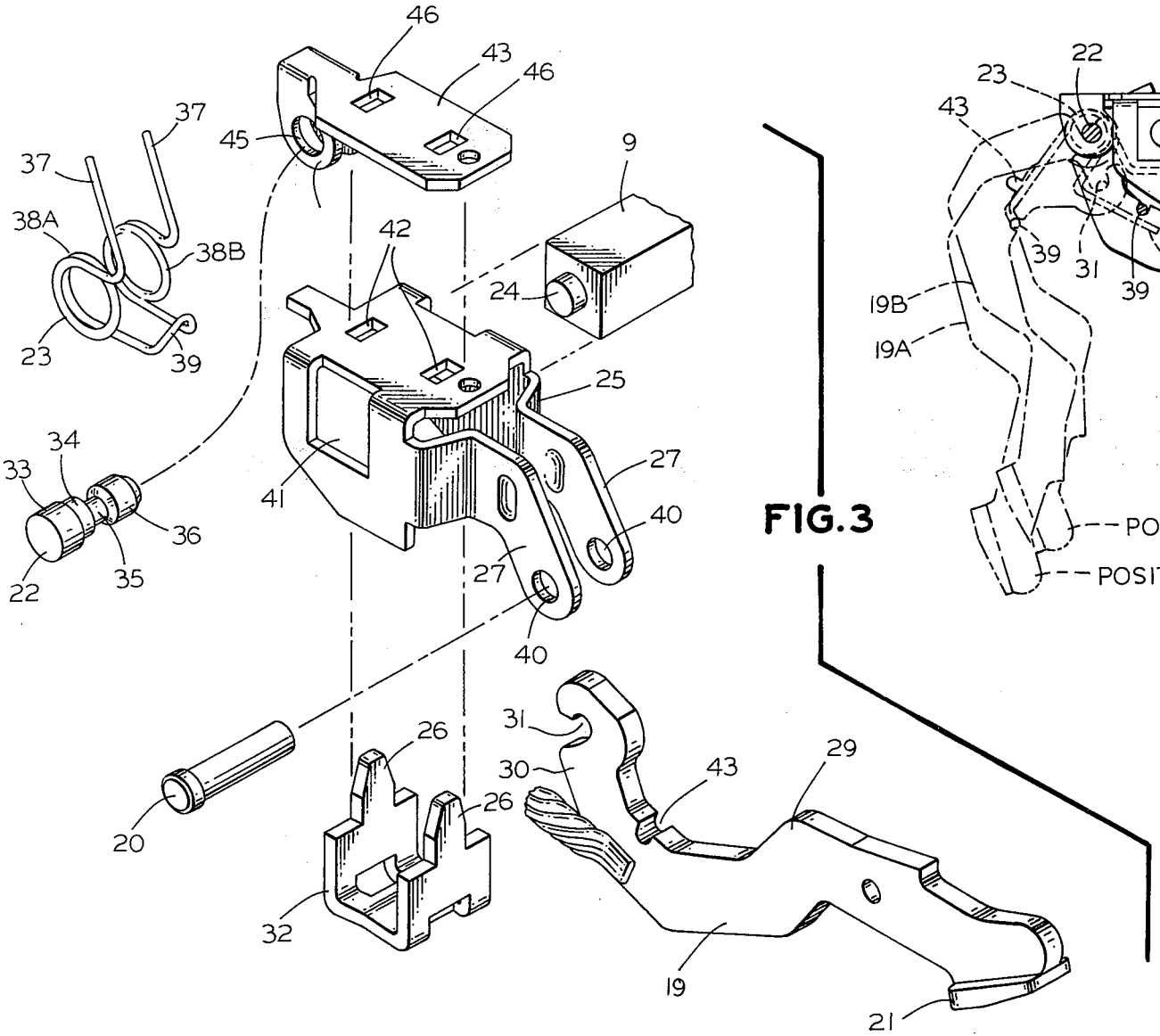
FIG. 3 is a top perspective view of the contact arm assembly of the invention with the parts depicted in isometric projection.

The assembly of contact arm 19 to the crossbar 9 can be seen by referring to FIG. 3 wherein the contact arm is depicted as a hook-shaped configuration having a well defined reverse bend. The contact arm is formed from a flat copper bar and a knee bend 29 is provided on one side and a hook-shaped bend 30 is provided on an opposite side. A hook-shaped slot 31 for mounting the contact arm to the contact retaining pin 22 is formed at one end and a spring slot 43 is cut on an opposite surface of the contact arm from the pivot slot. The movable contact 21 is welded to the end of the contact arm opposite pivot slot 31.

Figure 4:
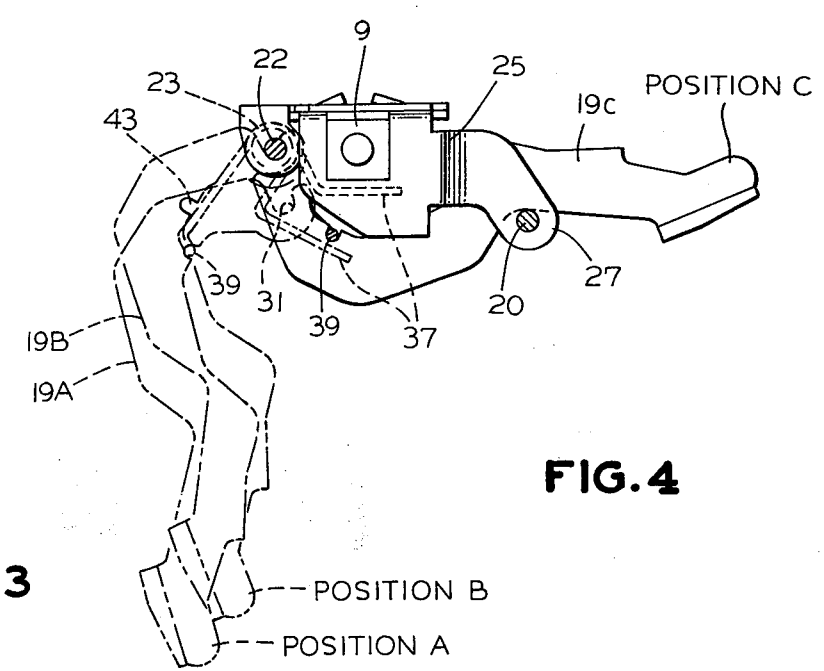
FIG. 4 is a side view of the assembled contact arm assembly according to the invention.

The contact arm 19 is assembled by first placing the contact carrier 25 on the insulated crossbar 9 by inserting the crossbar through a rectangular crossbar slot 41 extending through the carrier. Staple 32 is then inserted from beneath the contact carrier around the insulated crossbar such that the staple tabs 26 extend through parallel slots 42 in the top of the contact carrier. The pivot carrier 43 is arranged on the contact carrier by aligning parallel slots 46 over the staple tabs 26. The tabs 26 are then riveted over to securely lock the crossbar to the contact and pivot carriers. Pin 22 is then inserted through holes 45 with shoulder 34 passing within hole 45 and the bottom of head 33 faces against the carrier. The end diameter 36 of pin 22 extends through the back hole 45 while bearing diameter 35 is centered between the two holes. Saddle spring 23 which is wire-wound in a crossover loop configuration having a pair of spring legs 37 separated by a number of body windings 38 interconnected by means of a crossover arm 39. The spring is mounted by inserting the spring ends 37 under the contact carrier legs 27 and arranging the crossover loop 38 around the head 33 and the protruding end diameter 36 of pin 22 as shown in FIG. 4. The contact arm is then mounted by placing slot 31 over the bearing diameter 35 on pin 22 and rotating the arm counterclockwise until spring slot 43 captures the spring crossover arm 39 which then biases the contact arm in a downward direction. The contact arm is continually rotated against the spring bias up between the contact carrier legs 27 before inserting pin 20 through the contact carrier holes 40 to retain the contact arm under the knee bend formed in the contact arm.

The assembly of the contact arm to the contact carrier can best be seen by referring now to FIG. 4 where position A indicates the contact arm 19A in phantom prior to inserting slot 31 over pivot pin 22. The contact arm 19B is depicted with pivot pin 22 captured within slot 31. The contact arm 19C is rotated counterclockwise between carrier legs 27 to final position C and the retainer pin 20 is inserted as described earlier. The retention of spring 38 via spring slot 43, spring legs 37 and crossover loop 39 is also shown.

Figure 2:
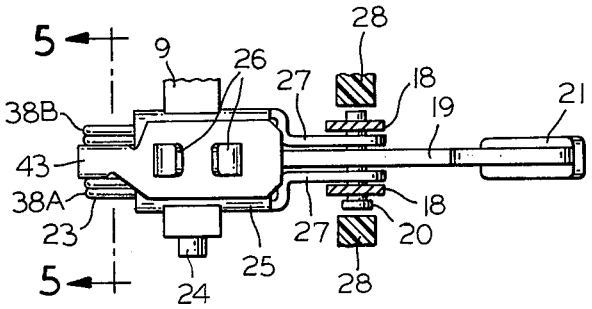
FIG. 2 is a plan view of the contact structure depicted in FIG. 1.
Figure 5:
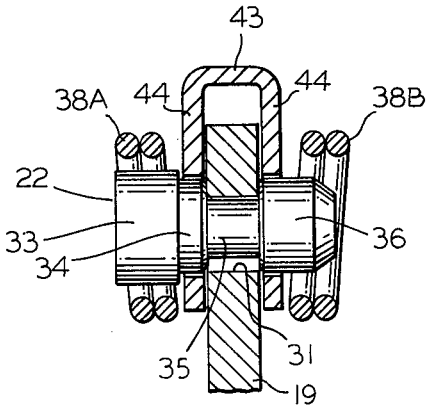
FIG. 5 is a crossection view of a portion of the contact arm assembly through the plane 5—5 depicted in FIG. 2.

The multi-functional spring and contact arm mounting arrangement of pin 22 can be seen by referring to FIG. 5 which depicts the spring and pin depicted in FIG. 2 in an enlarged crossection. When pin 22 is fully within holes 45 through pivot carrier 43, bearing diameter 35 of pin 22 receives the pivot end of contact arm 19. The head 33 provides a convenient mounting base for one set of body windings 38A of spring 23 while the end diameter 36 of pin 22 provides a mounting base for the other set of body windings 38B. It is also shown in FIG. 5 that slot 31 of contact arm 19 is intentionally smaller than end diameter 36 on pivot pin 22 to effectively lock the pivot pin in its operative position. This is an important feature since otherwise some additional locking means would be required.

The operation of the contact arm arrangement of the invention is best described by referring to FIG. 1 and FIG. 3 wherein the contact arm 19 is depicted in a hook-shaped or reverse bend configuration and wherein the contact arm is pivotally assembled at its end opposite from the movable contact 21. When handle 13 is moved from the ON to the OFF position, the upper link 14, lower link 18 and over center spring 16 respond in the manner described in the aforementioned U.S. Patent to Dimond et al. such that contact arm 19 is rotated counterclockwise to 19' and the movable contact 21 moves to 21' to interrupt the circuit through the breaker. When the crossbar 24 rotates in a counterclockwise direction under the influence of the breaker tripping mechanism, the contact arm 19 and movable contact 21 also assume the open position indicated at 19' and 21' respectively. However, under short circuit conditions, the magnetic forces of repulsion formed between movable contact 21 and fixed contact 5 are sufficient to rapidly below the contact arm 19 into the open position indicated at 19' prior to the rotation of crossbar 9 under the influence of the magnetic trip unit. By locating of contact spring 23 around the pivot pin 22 with the spring bias force exerted upon contact arm 19 close to the pivot point, and by locating spring slot 43 proximate pivot slot 31, it has been determined that the spring force remains nearly constant as the contact arm proceeds from its closed to open position under the influence of the magnetic forces. The contact assembly described within the patent to Dimond et al. rapidly increases in spring force as the contact arm attempts to open under the magnetic repulsion forces. The rapid increase in spring force opposes the forces of repulsion allowing for short circuit current let-through until the tripping mechanism operates to rotate the crossbar and move the contact arm to its fully open position. The rapid movement of contact arm 19 to its fully open position 19' is an important feature of this invention. The provision of the hook-shaped bend 30 allows the contact arm to traverse to its fully open position before the inner surface of the hook-shaped bend contacts the bottom surface of the crossbar assembly. The provision of a hook-shaped bend proximate the pivot point is also an important feature of this invention. The location of pin 20 under the knee bend portion 29 of contact arm 19 mechanically links the contact arm with the contact carrier 25 so that rotation of the crossbar 9 allows the contact arm to move together with the crossbar yet allows the contact arm to move independently in the manner described for short circuit conditions.

Having described our invention, what we claim as new and desire to secure by Letters Patent is:

1. An improved circuit breaker contact arm arrangement for use in electric circuit breakers of the type having a trip mechanism operatively coupled by a crossbar to a pair of electrical contacts within a casing, which contacts are also operatively coupled to an ON-OFF handle for opening and closing the contacts independent of the trip mechanism, wherein the improvement comprises:

a hook-shaped movable contact arm having a pivot end opposite from a contact end and mechanically coupled with said ON-OFF handle by means of an overcenter spring and a pair of upper and lower links pivotally interconnected, said lower link being held in contact with said movable contact arm by means of a support pin, and said contact arm being pivotally joined to a contact carrier at said pivot end for allowing said contact arm to move to an open position under short circuit conditions independent from said trip mechanism;

a contact spring arranged between said contact carrier and said contact arm proximate said pivot end for biasing said contact arm against said support pin, said contact spring comprising a crossover loop torsion spring including a pair of spring ends and a plurality of spring windings joined by a crossover arm.

2. The improved circuit breaker contact arm arrangement of claim 1 wherein said contact spring is attached to said contact carrier by means of a pivot pin inserted through said spring coils and is operatively connected with said contact arm by means of said crossover arm.

3. The improved circuit breaker contact arm arrangement of claim 2 wherein said pivot pin includes a head diameter, shoulder diameter, bearing diameter and end diameter, said head and end diameters supporting said spring coils, said shoulder diameter being inserted within an opening through a pivot carrier and said bearing diameter receiving a slot provided within said contact carrier at said pivot end.

4. The improved circuit breaker contact arm arrangement of claim 1 wherein said hook-shaped contact arm comprises a knee-shaped bend and a hook-shaped bend on reverse sides along said contact arm.

5. The improved circuit breaker contact arm arrangement of claim 1 wherein said contact carrier includes a pair of parallel legs depending from said carrier and wherein said support pin is inserted through a pair of holes through each of said legs.

6. An improved circuit breaker contact arm arrangement for use in electric circuit breakers of the type having a trip mechanism operatively coupled by a crossbar to a pair of electrical contacts within a casing, which contacts are also operatively coupled to an ON-OFF handle for opening and closing the contacts independent of the trip mechanism, wherein the improvement comprises:

a hook-shaped movable contact arm having a pivot end opposite from a contact end and mechanically coupled with said ON-OFF handle by means of an overcenter spring and a pair of upper and lower links pivotally interconnected, said lower link being held in contact with said movable contact arm by means of a support pin, and said contact arm being pivotally joined to a contact carrier at said pivot end for allowing said contact arm to move to an open position under short circuit conditions independent from said trip mechanism, said contact carrier including a pair of parallel legs depending from said carrier and wherein said support pin is inserted through a pair of holes through each of said legs, and said support pin being located under said knee-shaped bend on said contact arm.

7. The improved circuit breaker contact arm arrangement of claim 6 wherein said pivot pin is locked within said pivot carrier opening by means of said bearing diameter being smaller than said end diameter.

8. The improved circuit breaker contact arm arrangement of claim 6 wherein said support pin is captured by ribs formed within said breaker casing.

9. The improved circuit breaker contact arrangement of claim 1 wherein said spring crossover arm is located on said hook-shaped bend on said contact arm.

10. The improved circuit breaker contact arrangement of claim 7 wherein said spring crossover arm is retained within said contact arm by means of a groove.

* * * * *